United States Patent [19]

Heuberger

[11] 4,154,346

[45] May 15, 1979

[54] TEAR-OPEN PACKING MEANS, PARTICULARLY FOR LIQUIDS SUCH AS OIL OR THE LIKE

[75] Inventor: Erich Heuberger, Heidenheim, Fed. Rep. of Germany

[73] Assignee: Carl Edelmann GmbH, Heidenheim, Fed. Rep. of Germany

[21] Appl. No.: 843,313

[22] Filed: Oct. 18, 1977

[51] Int. Cl.[2] ..... B65D 5/72

[52] U.S. Cl. ..... 206/629; 220/410; 229/17 R

[58] Field of Search ..... 229/17 R, 14 B; 206/620, 629, 630; 220/404, 410, 408

[56] References Cited

U.S. PATENT DOCUMENTS

| | | | |
|---|---|---|---|
| 2,850,222 | 9/1958 | Hultin | 229/17 R |
| 2,982,461 | 5/1961 | Hultin | 229/17 R |
| 3,003,673 | 10/1961 | Clark et al. | 229/17 R |
| 3,113,712 | 12/1963 | Kindseth | 229/17 R |
| 3,270,942 | 9/1966 | Cope et al. | 229/17 |
| 3,367,553 | 2/1968 | Francis | 229/17 R |
| 3,550,833 | 12/1970 | Rohenkamp | 229/17 R |
| 3,741,463 | 6/1973 | Young et al. | 229/17 R |

FOREIGN PATENT DOCUMENTS

| | | | |
|---|---|---|---|
| 6929371 | 7/1969 | Switzerland. | |
| 1228764 | 4/1971 | United Kingdom | 229/14 B |

*Primary Examiner*—Stephen P. Garbe

[57] ABSTRACT

The packing means of this invention includes a liquid impervious inner bag that is sealed at its upper end and which is closed at its bottom end. The bag is positioned within a tubular folding box which is closed at the bottom and which has, at its upper end, closure flaps hinged to three of the sidewalls. One of the closure flaps is adhesively secured to the sealed end of the inner bag so that when the adhesively secured closure flap, or a portion thereof, is torn away the inner bag is automatically opened and a pouring spout is formed.

12 Claims, 5 Drawing Figures

TEAR-OPEN PACKING MEANS, PARTICULARLY FOR LIQUIDS SUCH AS OIL OR SIMILAR

The invention relates to a tear-open packing means, particularly for liquids such as oil or the like. The invention comprises an inner bag which is impervious to liquids and is sealed at its upper end with an impervious cross-seam, and a tubular folding-box casing formed from a cardboard blank, which is closed at the bottom and at whose upper ends of three side walls closure flaps are hinged which, like the cross-seamed end of the inner bag, are folded downwards in the plane of the upper end of the box, at least one of the upper lid flaps being divided by a perforation to form a tear-off portion, and in which furthermore the cross-seamed end of the inner bag has a tearing notch under the perforated lid flap to form an opening for pouring.

Tear-open packing means for liquids are known in various embodiments; there are usually milk packs in the form of bags, which are folded together at their upper end and sealed by an upwardly projecting vertical fold. The pack is usually torn open by cutting into or cutting off part of the vertical fold from one side, whereupon the folded-in wall section of the pack can be pulled outwardly with more or less difficulty, to form a spout. However, such bag packs with a vertical fold are not always desirable or usable.

The object of the invention is to provide a tear-open packing means, particularly for packing liquids, specifically oil and similar goods, or any other sensitive loose material. The tear-open packing means of this invention corresponds both in its construction and in its outward appearance to a folding box, and is essentially constructed in the manner of a so-called inner bag packing, which however can be opened simply and safely in one step, so that a pouring opening with a spout. is formed immediately on opening. Such a packing means is intended particularly to replace more expensive packagings which are normally used.

To solve this object, it is proposed according to the invention that an inner bag packings means is constructed as a tear-open packing for liquids or possibly also for other loose material. The tubular folding casing is made in such a manner that a first upper lid flap containing a perforation, or a notch and a perforation, is arranged facing a upper lid flap, which is divided into two sections by a cut. The cross-seamed end of the inner bag lies above the one of the two flap sections and beneath the adjacent second flap section of the second, upper lid flap. The first upper lid flap is glued at its tear-off portion to the subjacent part of the cross-seamed bag end and at its other flap portion to the second section of the lower second lid flap which overlaps the bag end. The tearing notch in the bag end is positioned underneath the perforation or cut in the upper first lid flap.

In a slight modification of the above-described tear-open packing means constructed according to the invention, it is unnecessary to divide the lower lid flap into two parts by a cut. It is merely necessary to make the end of the inner bag, containing the sealed cross-seam, narrower, so that when this end of the inner bed is placed on the lower lid flap it does not completely cover the latter. Thus, the fixed part of the upper lid flap can be glued both to the bag end and to the portion of the lower lid flap which is not covered thereby.

Preferably, in order to form a pouring spout at the upper end of the inner bag for simplifying and furthering the pouring out of the contents of the packing means, the latter is so constructed that such part of the lower lid flap which is covered by the bag end is cut off obliquely towards one side wall, and that the tearing edge of the tear-off portion of the upper lid flap also runs obliquely towards the same side wall.

Expediently, on the tear-off portion of the upper lid flap of an above-described tear-open packing means, there is a flap member projecting above the lid surface which is laid against the side wall close to the tear opening and is attached thereto so as to be easily removable.

In a further embodiment of the tear-open packing means constructed according to the invention, the flap member which is attached to the upper lid flap and folded against the one side wall is separated from the tear-off portion by two parallel-running perforations, and the tear-off portion is in turn firmly attached to the subjacent part of the bag end, so that when the tear-off portion is pulled away, the bag is torn open, starting from the notch, into its sealed cross-seamed edge, and a pouring opening or spout is formed.

It is furthermore advantageous if, close to the tear opening, the side wall and possibly also the lid of the cardboard casing are provided in their center with a scored groove which makes it easier to press the packing together close to the pouring opening to make a well-formed spout. It is also expedient for the inner bag to be firmly glued to the inside wall of the side wall close to the tear opening.

In FIGS. 1 to 5 of the drawings, the subject matter of the invention is shown with reference to several particularly preferred embodiments, which are described in greater detail below.

Figure 1:
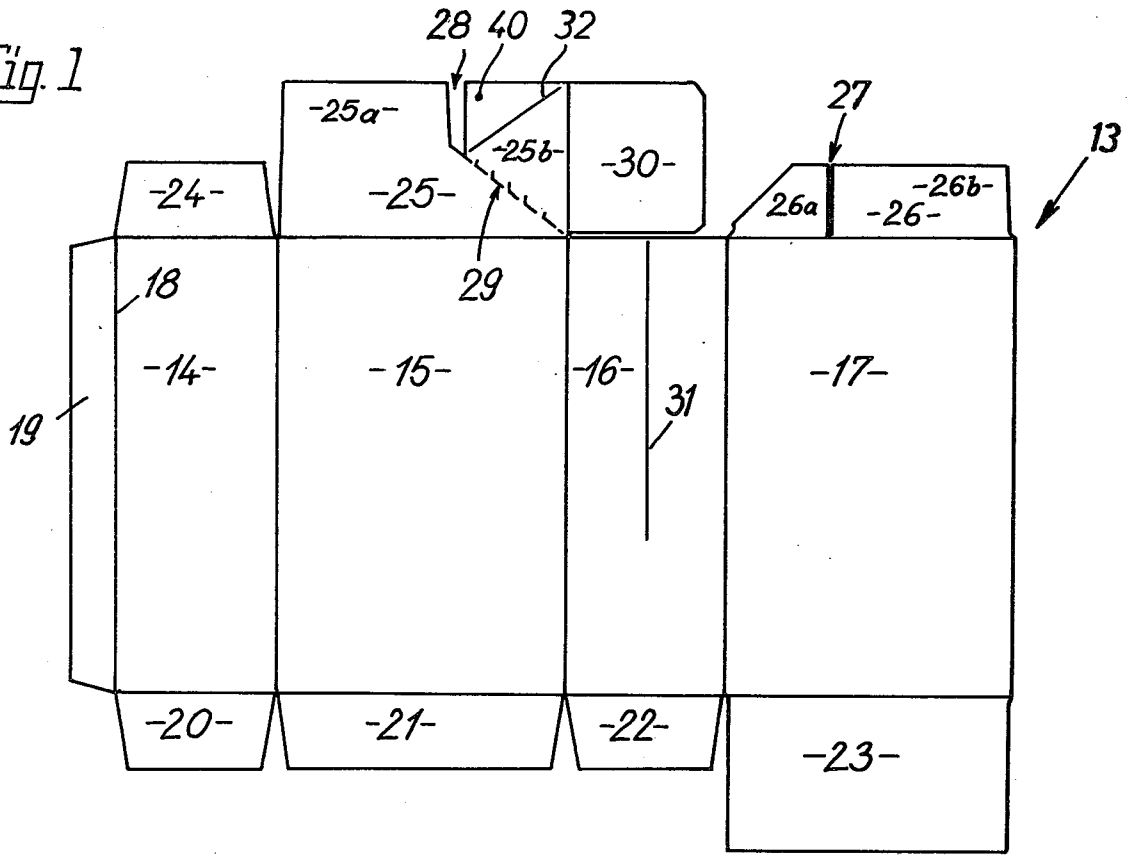
FIG. 1 is a plan view of a carton blank for forming the cardboard casing round the inner bag.

As can be seen from FIGS. 1 and 2 of the drawings, the outer casing 11 of the inner bag 12 is formed from a carton blank 13 having four connected side walls 14, 15, 16 and 17, on which the flaps described hereinbelow are disposed. On one long edge 18 of side wall 14 is the joining flap 19 which is adhered to side wall 17. The floor is formed by the bottom flaps 20, 21, 22 and 23 extending from side walls 14 to 17. The lid is formed by upper lid flaps 24, 25 and 26 which are connected to the side walls. Lid flap 26 is half as wide as the depth of the packing means, and is also divided by a cut 27 into a first flap section **26*a* and a second flap section 26*b***.

The lid flap 25, which forms the upper covering on the lid side when the packing is completed, is likewise divided into flap portions **25*a* and 25*b* by a cut 28 and the perforation 29. Connected with flap portion 25*b* is flap member 30, which partially covers side wall 16 when the packing is finished. In the center of the side wall extending downwardly from the upper edge, there is a scored groove 31. Preferably, the lid flap portion 25b has a scored groove 32**.

The tear-open packing means according to the invention is constructed in a conventional manner at its lower end as regards the bottom closure, and has the following shape at its upper end. The inner bag 12 is closed in a conventional manner after filling, the filling hole of the bag being spread out broadwise so that the edges lie against one another and can be sealed together. On sealing, the bag end 33 is provided with a notch 34 (FIG. 2), which has the task of simplifying the tearing of the bag edge 33 to form the tear opening when the packing is torn open. Flap section 26a is first folded over, and on it rests the sealed cross-seamed bag end 33, which is folded across its entire width towards the front side wall 17. Then the lid flap 24 is folded inwards with that part of the bag end 33 which is resting on it. After this the other, lower flap section 26b is turned over and rests partially on the lid flap 24 and the bag end 33. The notch 34 in the bag end 33 lies underneath the cutting edge 35 of the cut 27 dividing the lower lid flap 26. Then the upper lid flap 25 is folded down and attached on the underside of lid flap portion 25a to lid flap section 26b by means of a coat of adhesive 36. Lid flap portion 25b is glued to the inner bag end 33 at area 38 by means of a coat of adhesive 37. Finally, flap member 30, which is hanging from the upper lid flap 25, is folded downwards towards side wall 16 and detachably adhered thereto by means of adhesive points 39.

Figure 3:
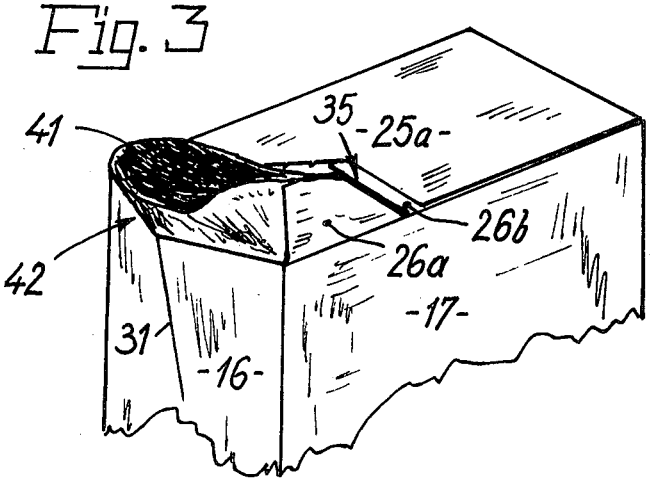
FIG. 3 is a fragmentary perspective view of the upper part of a torn-open packing means according to FIG. 1 and 2.

To open the tear-open packing means according to the invention it is merely necessary to grip the corner 40 of the upper flap portion 25b, pull this flap portion upwards wards and sideways towards the tear opening, during which flap portion 25b, being glued to the inner bag end 33, tears into it and thus tears open the inner bag 12 in such a manner that a tear opening 41 with a pouring spout 42 is created at the upper end of the packing means in the vicinity of side wall 16, as can be seen from FIG. 3. On tearing, flap portion 25b of the lid flap 25 is divided along the perforation 29 and the attached flap member 30 is removed from the side wall 16 of the packing means. By squeezing the packing means at the upper end near the pour opening, which is aided by the scored groove 31, the form of the pouring spout 42 can be shaped as described.

Figure 2:
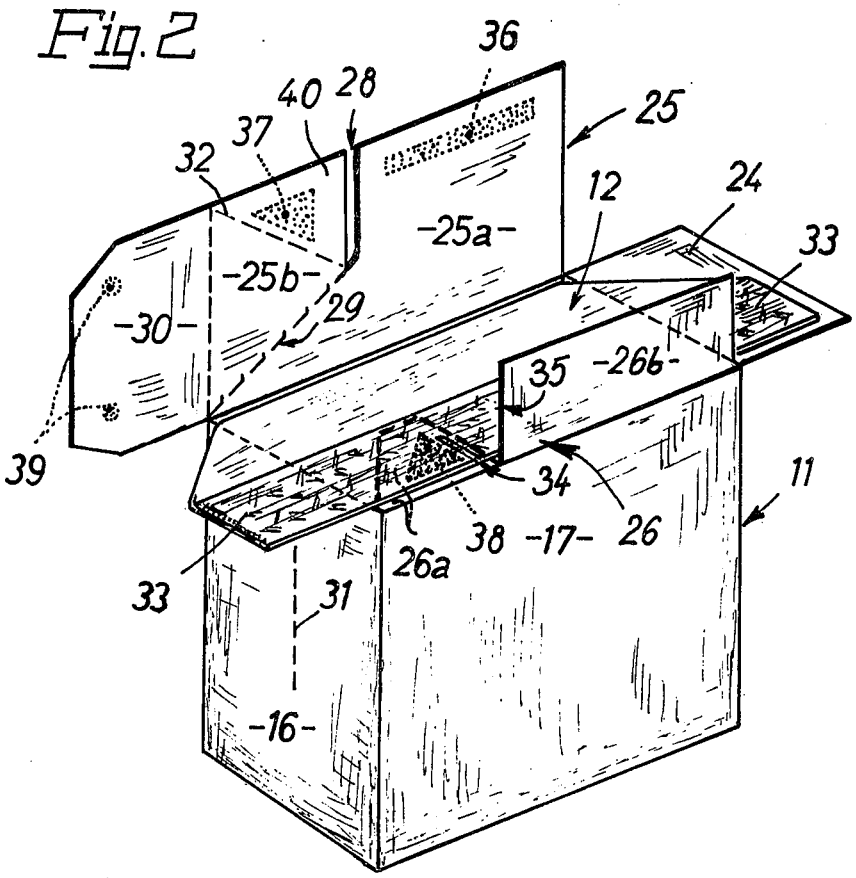
FIG. 2 is a perspective view of the tear-open packing means in the form of an inner bag packing during one stage of sealing the packing means.
Figure 4:
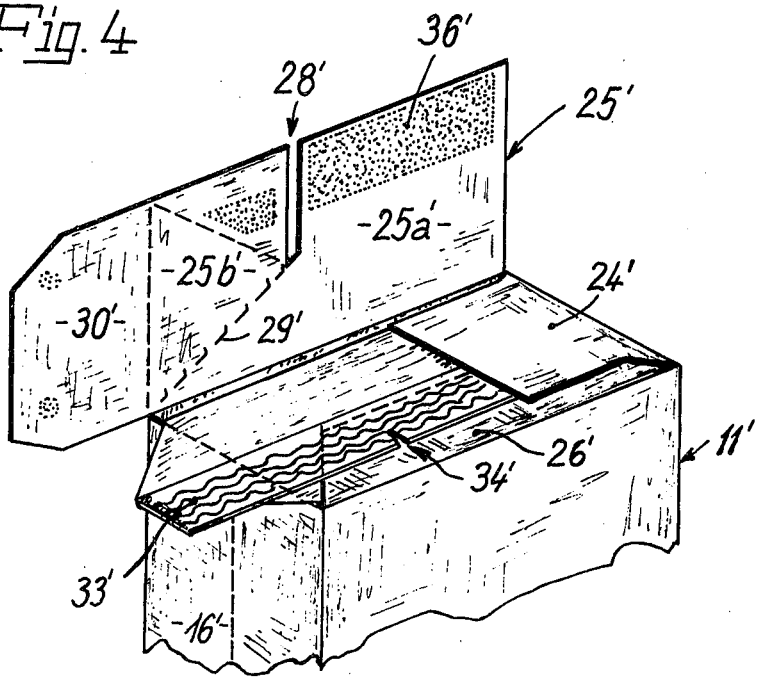
FIG. 4 is a fragmentary perspective view illustrating the upper part of a tear-open packing means in an alternative embodiment of the present invention as compared to FIG. 2.

The packing means shown in FIG. 4, which is slightly modified and somewhat simplified by comparison to the packings according to FIGS. 1 to 3, has an undivided lower lid flap 26', which is partially overlapped by the bag end 33' comprising the sealing cross-seam. When the upper lid flap 25' is folded over, lid flap portion 25a' is attached by means of adhesive coating 36'on one side to the side flap 24' and on the other side to the free-lying part of the lower lid flap 26' and the adjacent part of the bag end 33'. Otherwise, the packing according to FIG. 4 corresponds to that of FIGS. 1 to 3.

Figure 5:
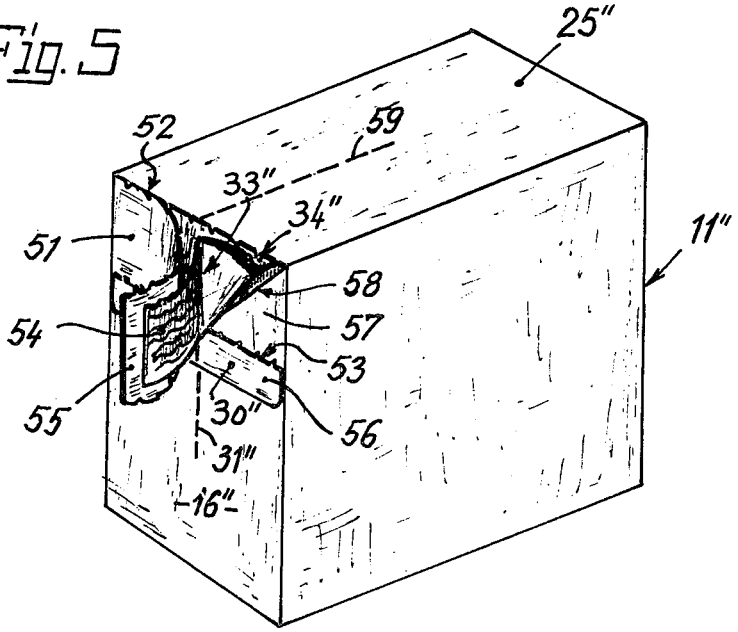
FIG. 5 is a perspective view of the upper part of a tear-open packing means during tearing of still another embodiment of the invention.

In a modified embodiment of the tear-open packing means according to the invention, shown in FIG. 5, the upper lid flap 25'' is also provided with a flap member 30'' which in this case includes tear piece 51, which is separated by perforations 52 and 53 respectively from the lid flap 25'' and from the remaining flap member 30'' which is glued to the side wall 16'' of the packing 11''. The tear piece 51 is firmly fixed to the corner 54 of the bag end 33'' comprising the sealing cross-seam. To tear open the packing 11'', the tear piece 51 is gripped at its edge 55 and pulled upwards. The tear piece 51 is thereby separated along perforations 52 and 53 respectively from the lid flap 25'' and from the remaining part 56 of the flap member 30'', and at the same time the inner bag is torn open, beginning at the notch 34'' in the bag end 33'', so that a pouring spout similar to that of FIG. 3 is formed. To make it easier to pour out the contents of the pack, and to form the spout correspondingly well, there is a V-shaped cutout 58 in the top edge 57 of the side wal 16''. The formation of the pouring spout is further simplified by the scored groove 31'' in side wall 16'' and by scored groove 59 in the upper lid flap 25'' as well as possibly in the partial flap 56; when the parallel side walls of the packing means are squeezed together near the pour opening, the side wall 16'' between them and the lid flap 25'' bend easily along the scored grooves 31'', 59, so that the pour opening of the pack is enlarged and room is made for the passage of air entering the packing on pouring. For this, it is advantageous for the upper bag edge under the lid flaps to be glued to them, so that if the lid flap bulges, the inner bag will be lifted with it.

What is claimed is:

1. Tear-open packing means, particularly for liquids such as oil or the like, said packing means comprising a liquid-impervious inner bag having a sealed cross-seam at its upper end and an outer tubular folding box-casing closed at the bottom and including a plurality of closure flaps that are hinged on the upper ends of three side walls of the folding box casng, the closure flaps and the cross-seamed end of the inner bag being folded down at the plane of the upper box edges, a first one of the closure flaps being divided into first and second sections, the first one of which is removable, at least a portion of a second one of the closure flaps being positioned beneath the folded down upper end of the bag, the first section of the first closure flap being adhesively secured to the upper end of the bag, the second section of the first closure flap being adhesively secured to a portion of the second one of the closure flaps, the third on of the closure flaps being positioned beneath the first one of the closure flaps.

2. The packing means according to claim 1 wherein the upper end of the bag has a notch therein to facilitate the tearing thereof when the package is opened.

3. The packing means according to claim 2 wherein said first closure flap is divided into sections by means of perforations that terminate proximate the notch in the bag end.

4. The packing means according to claim 2 wherein said first closure flap is divided into sections by means of perforations and a notch, the perforations terminating proximate the notch in the bag end.

5. The packing means according to claim 1 wherein the second one of the closure flaps is also divided into first and second sections, the means dividing the first closure flap being in opposition to the means dividing the second closure flap, the first section of the second closure flap being positioned beneath the end of the bag, the second section of the second closure flap being positioned over the end of the bag.

6. The packing means according to claim 5 wherein the second closure flap is divided into sections by means of a notch.

7. The packing means according to claim 5 wherein a part of the second closure flap covered by the bag end is cut off obliquely towards one side wall of the folding box casing and the tearing edge of the removable first section of the first closure flap runs obliquely towards the same side wall.

8. The packing means according to claim 1 wherein the second section of the first closure flap is adhesively secured to the end of the bag and to the portion of the second closure flap which is not covered thereby.

9. The packing means according to claim 1 wherein the first section of the first closure flap further includes a panel that is adhesively secured to a side wall of the folding box casing.

10. The packing means according to claim 9 wherein the side wall to which the panel is secured is scored by a groove extending downwardly from the upper end of the folding box casing to facilitate the formation of a pouring spout.

11. The packing means according to claim 1 wherein the second closure flap is undivided and is positioned partially underneath the bag end, the third closure flap being positioned over the bag end and the second closure flap, the first closure flap being positioned over the bag end, the second closure flap and the third closure flap, the second section of the first closure flap being adhesively secured to the bag end, the second closure flap and the third closure flap, the first section of the first closure flap being adhesively secured to only the bag end.

12. The packing means according to claim 11 wherein the bag end is notched and wherein the notch is in alignment with the means dividing the first closure flap into first and second sections.

* * * * *